United States Patent [19]

Lovering

[11] 4,309,857

[45] Jan. 12, 1982

[54] SOFFIT SUPPORTING STRUCTURE

[75] Inventor: Dennis W. Lovering, Wolverhampton, England

[73] Assignee: Kwikform Limited, Birmingham, England

[21] Appl. No.: 67,800

[22] Filed: Aug. 20, 1979

[30] Foreign Application Priority Data

Sep. 8, 1978 [GB] United Kingdom ..... 36197/78

[51] Int. Cl.[3] ..... E04G 25/00

[52] U.S. Cl. ..... 52/632; 52/90

[58] Field of Search ..... 52/90–93, 52/632

[56] References Cited

U.S. PATENT DOCUMENTS

| | | | |
|---|---|---|---|
| 2,711,806 | 6/1955 | Smith | 52/632 |
| 3,137,098 | 6/1964 | Elia et al. | 52/632 X |
| 3,325,957 | 6/1967 | Demeules et al. | 52/632 |
| 3,680,711 | 8/1972 | Brucker | 52/632 X |
| 4,018,020 | 4/1977 | Sauer et al. | 52/632 X |
| 4,147,321 | 4/1979 | Gostling | 52/632 |

FOREIGN PATENT DOCUMENTS

| | | | |
|---|---|---|---|
| 193118 | 11/1957 | Austria | 52/90 |
| 1299436 | 10/1972 | United Kingdom . | |
| 1433176 | 4/1976 | United Kingdom . | |
| 1079186 | 8/1976 | United Kingdom . | |

*Primary Examiner*—J. Karl Bell

*Attorney, Agent, or Firm*—Friedman, Goodman & Teitelbaum

[57] ABSTRACT

This invention relates to a supporting structure to support a soffit, comprising at least two parallel spaced vertically disposed props connected together by a horizontal member, each prop being provided with a supporting head which supports the primary shoring beam for supporting the soffit. The beam extends between the props, one end being fixed longitudinally of the beam and the opposite end being variable longitudinally of the beam, two or more adjacent beams being telescoped one within the other.

13 Claims, 3 Drawing Figures

SOFFIT SUPPORTING STRUCTURE

BACKGROUND OF THE INVENTION

FIELD OF THE INVENTION

This invention relates to a supporting structure to support a soffit of the type, hereinafter referred to as of the type described, comprising at least two parallel spaced vertically disposed props connected together by a horizontal member or members each prop being provided with a supporting head at its upper end and a primary shoring beam at its upper side for supporting the soffit, said beam extending between the props with opposite ends of the beam being supported on the supporting heads of the props.

The object of the invention is to provide a new and improved supporting structure of the type described for supporting a sloping soffit i.e. a soffit lying in a plane inclined to the horizontal.

SUMMARY OF THE INVENTION

According to one aspect of the invention we provide a supporting structure of the type described to support a sloping soffit wherein the primary shoring beam is supported at one end by a first supporting head at a position which is fixed longitudinally of the beam and at the opposite end by a second supporting head at a position which is variable longitudinally of the beam.

The vertically disposed props in a structure of the type described are usually located at positions which are predetermined by the length of horizontal member or members of the structure.

As the structure needs to be capable of supporting soffits at different angles of slope, the props need to be adjustable in length and hence the distance between adjacent supporting heads varies depending upon the angle of slope of the soffit to be supported.

In a supporting structure according to the present invention, the position of support of each primary shoring beam relative to a prop is fixed at only one end, and thus the supporting structure can accommodate the above mentioned variable distance between adjacent support heads and so can be used to support a soffit of any desired angle of slope within wide limits.

The fixed position of support may be at the higher or the lower end of the primary shoring beam.

The beam may be of generally channel section and is preferably of top hat section provided with an inturned lip at the free ends of the out-turned flanges.

The beam may be made in sheet material such as, for example, steel, and the beam may be provided with longitudinally extending bracing members.

Said one end of the beam may be provided with an abutment surface which engages a corresponding abutment surface on the head to prevent movement of the beam relative to the head in the longitudinal direction of the beam.

In one embodiment, the abutment surface may be provided by a spigot and socket assembly, and the spigot may be provided on the head and socket on the beam.

Preferably two sockets, in the form of apertures are provided on the beam at a position spaced transversely of the longitudinal axis of the beam and the head is provided with correspondingly located spigots extending generally radially from a cylindrical beam-engaging surface of the head.

It will be appreciated that in this embodiment, as well as preventing movement in a direction longitudinally of the beam the spigot and socket arrangement also prevents movement transversely of the beam relative to the supporting head.

Also in this embodiment the fixed position of the support is preferably at the lower end of the sloping beam.

In a second embodiment, the abutment surfaces may comprise a protrusion and a wall of a corresponding recess, and the protrusion may be provided on the head and the recess on the beam.

The protrusion may comprise a cylindrical beam-engaging surface of the head and the recess may be a substantially similar configuration cut-out portion in the beam.

Additional abutment surfaces may be provided to prevent transverse movement of the beam relative to the supporting head.

The additional abutment surfaces may comprise collars on the cylindrical beam engaging surface of the head which, in use, abut the beam in the region of the cut-out portion.

In this embodiment, the fixed position of support is preferably at the higher end of the sloping beam.

The supporting structure may be part of a soffit supporting system comprising a plurality of said supporting structures, in which case adjacent primary shoring beams may be supported on the same supporting head.

In a soffit supporting system of this type, an end of each primary beam may be of reduced cross section compared with the opposite end of the beam and thus be adapted to be telescoped with a corresponding opposite end of an adjacent beam.

Preferably the dimensions of the telescoped parts are such that the reduced cross section end may be moved out of engagement with its associated supporting head whilst the end of the opposite end of the adjacent beam also supported on the supporting head remains supported by the head.

Where abutment surfaces comprising a spigot and socket assembly are provided to prevent movement of the beam relative to the head in the longitudinal direction of the beam, and said spigot is provided on the supporting head the socket may be provided on the reduced cross section end of the beam, and the length of the or each spigot and the space between the telescoped ends of the adjacent beams may be such that the reduced cross section end of the beam can be lifted out of engagement with the spigots and slid in an axial direction to permit removal of the beam from the structure.

Where the abutment surfaces comprise a protrusion and a recess, the recess may be provided on the end of the beam opposite to the reduced cross section end, and the height and depth of the protrusion and recess and the space between the telescoped ends of the adjacent beams may be such that the reduced cross section end of the beam can be lifted out of engagement with the supporting head and slid in its axial direction to permit removal of the beam from the structure.

According to another aspect of the invention we provide a sloping soffit or shuttering for a sloping soffit when supported by a supporting structure according to the first aspect of the invention.

The invention will now be described in more detail by way of example with reference to the accompanying drawings wherein:

DETAILED DESCRIPTION

Figure 1:
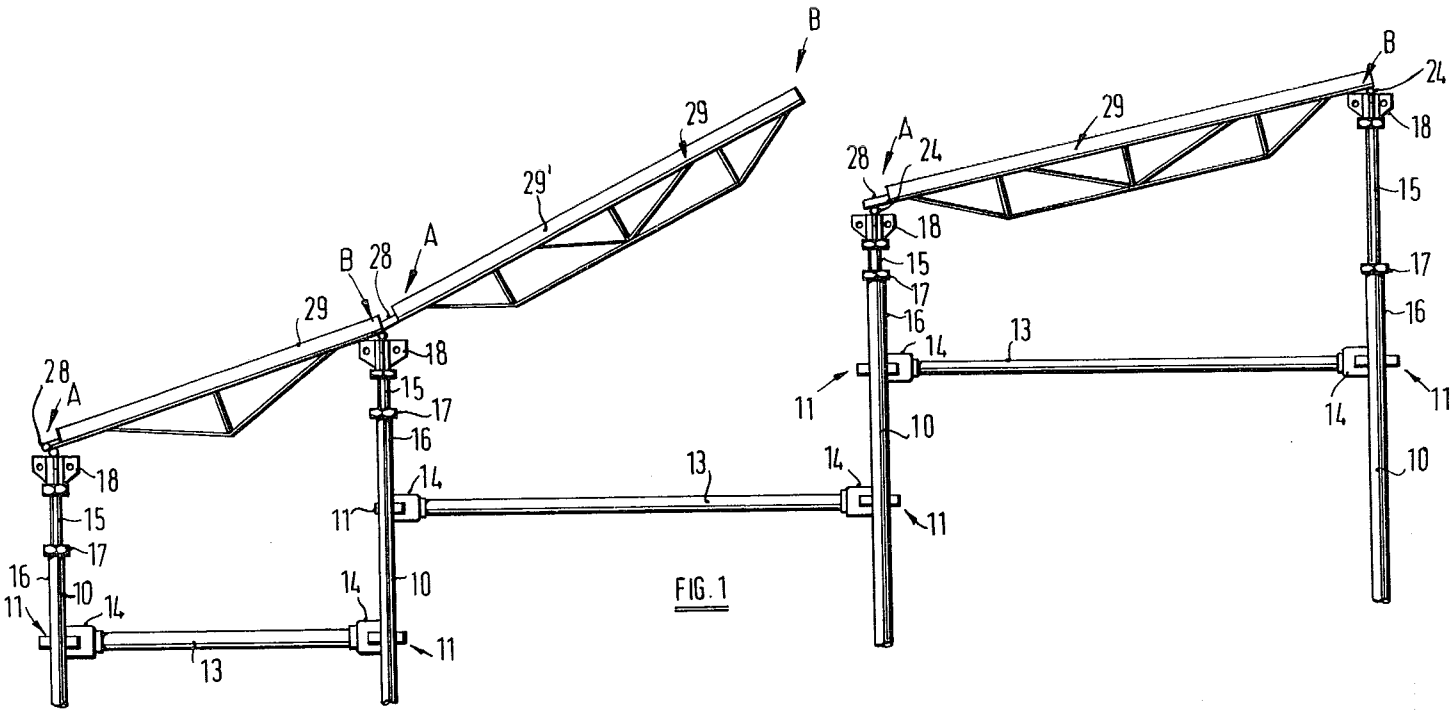
FIG. 1 is a diagrammatic fragmentary side elevation of part of a soffit supporting structure system incorporating a first embodiment of the invention.
Figure 2:
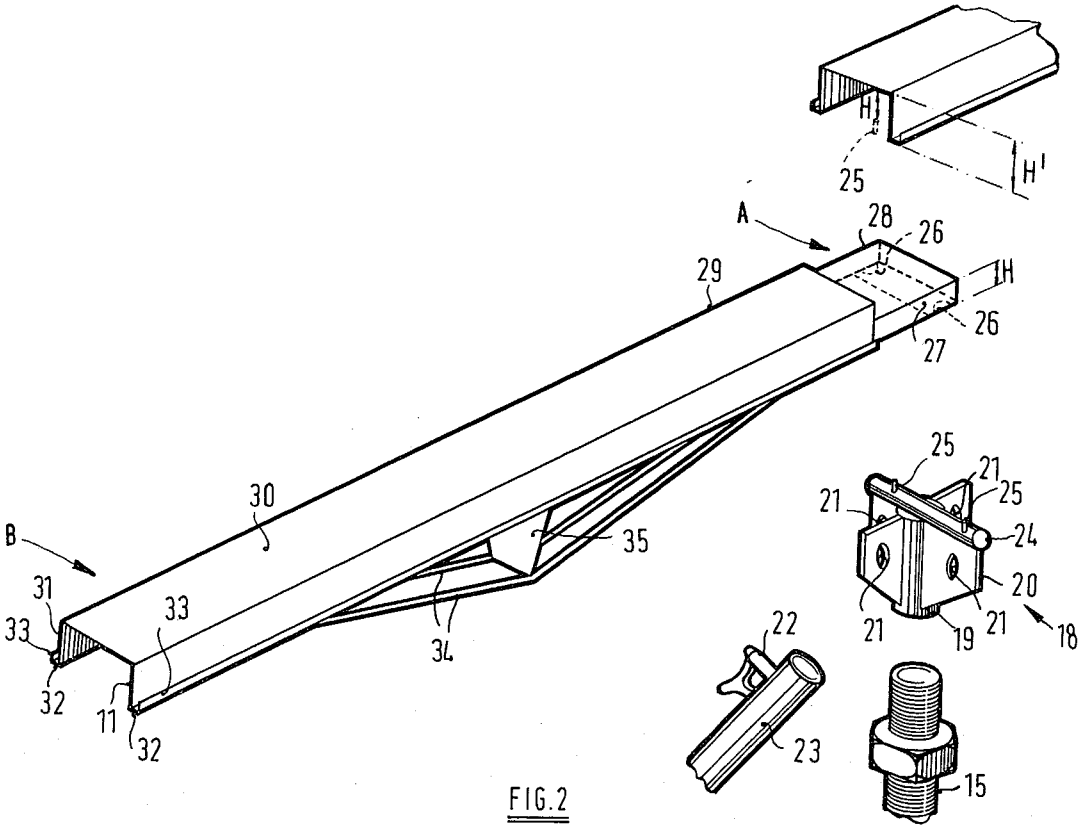
FIG. 2 is an exploded perspective view, to an enlarged scale, of part of the structure of FIG. 1.

Referring to the FIGS. 1 and 2, there is shown a supporting structure for a sloping soffit, which is inclined to the horizontal over an upper part of its length at an angle of 14°, and over a lower part of its length at an angle of 19°. The system comprises a plurality of variable length uprights 10. Each upright 10 is provided at spaced intervals along its length with groups of sockets 11 by means of which the uprights are connected together by horizontal cross members 13. The members 13 each include at opposed ends thereof, connecting means 14 for engaging the sockets 11. Preferably, the connecting means 14 are engaged with the sockets 11 by wedges as disclosed in our prior British patent specifications Nos. 985 912/3; 1,163,532/3; 1,180,562 or 1,278,596.

Each upright 10 comprises an adjustable length prop having a threaded rod 15 telescoped within a cylindrical part 16 of the prop and in threaded engagement with a rotatable lock nut 17, the rotation of which permits adjustment of the extent of projection of the rod 15 from the cylindrical part 16 and hence of the overall height of the upright 10.

At its upper end each threaded rod 15 carries a primary shoring beam supporting head 18 which, as best shown in FIG. 2, comprises a cylindrical tube part 19 having four radially extending lugs 20 at equi-angularly circumferentially spaced positions there around. Each lug 20 is provided with an aperture 21 which may receive a pin 22 fixed to a diagonal bracing member 23. The lugs 20 are welded to the cylindrical part 19.

A cylindrical bar 24 is also welded to the cylindrical part 19 and extends diametrically of the cylindrical part 19 aligned with two of the lugs 20.

Two beam engaging spigots 25 extend vertically upwardly from the bar 24 and are adapted to be received in apertures 26 formed in a base plate 27 welded across a reduced cross sectional part 28 of a primary shoring beam 29.

Each beam 29 comprises at one end, a reduced cross section channel section part 28 whilst the remainder of the beam 29 is of top hat cross section having a top part 30, spaced side flanges 31 and out-turned flanges 32 the free ends of which have an upturned lip 33. The beam 29 is made from sheet steel, the reduced cross section part 28 being welded inside the top hat cross section part and having a width which fits within the internal dimensions of the part 30 and a height, indicated at H in FIG. 2, which is significantly less than the height H1 of the flanges 31 for a reason to be hereinafter explained. A pair of bracing members 34 comprising rods are provided on the underside of the beam 29 in combination with a bracket 35 to reinforce the beam 20 in its longitudinal direction.

Each beam 29 is supported at one end shown, at A in FIG. 1, upon a support head 18 in such manner that the plate 27 rests on the upper surface of the cylindrical bar 24 with the spigots 25 extending into the sockets provided by the apertures 26. Therefore, at this one end A, each beam 29 is supported on its associated support head 18 at a location which is fixed longitudinally of the beam.

At its other end, indicated at B in FIG. 1, each beam 29 is supported on its associated support head by virtue of engagement of the undersurface of the outturned flanges 32 with the cylindrical bar 24 of its associated support head 18 and thus is not fixed longitudinally and hence variation in the spacing between support heads 18 at each end of the beam 29 on an adjacent upright 10, can be accommodated.

A beam 29' intermediate two other beams 29 may be introduced into the supporting structure by introducing the beam in the orientation shown in FIG. 1 so that its reduced cross section end part 28 is engaged within the other end part B of the next lowest beam, the height H of the reduced cross section part being such in relation to the length of the spigot 25 and the height H' of the next lowest beam 29, so as to permit the reduced cross section part 28 to be introduced into the other end part B of the next lowest beam above the spigots 25, following which the spigots 25 can be introduced into the sockets 26 and then the other end part B of the beam 29 lowered onto the reduced cross sectional part 28 of the next highest beam 29.

If desired, the intermediate beam 29' can also be removed from a cast soffit whilst permitting other beams to remain in position. For example, the soffit may be of concrete the part of which is supported by the intermediate beam 29' having matured sufficiently so as not to require further support whilst the remainder of the soffit may still require support. In this case the upright 10 supporting the end B of the beam to be removed, distant from the other end A adjacent a beam to remain, is lowered so that the beam to be removed can be pivoted about the support at the other end A and the clearance between the reduced cross section part 28 at the end A of the beam to be removed and the larger cross section part of the beam to remain is such that the spigots 25 can be disengaged from the apertures 26 to permit withdrawal of the end A of the beam to be removed from the end B of the beam 29 to remain.

As shown in FIG. 1, a supporting structure according to the present invention is able to support a soffit which has different angles at different parts, but if desired the structure could be used, of course, to support a soffit of constant slope. Also, although for the sake of example a supporting structure has been illustrated in which two of the uprights are shown spaced apart by 1.8 meters and a further upright spaced by 1.2 meters, if desired the structure may be made of uprights of constant spacing or of other combinations of different spacings depending upon the design of support structure required and the lengths of the standard components from which it is to be made up.

The means for fixing the location of said one end A of each beam to its associated support head may differ from that described hereinbefore. If desired, one spigot and socket only may be provided and the or each spigot and socket may be of shapes other than cylindrical as described hereinbefore. For example, the spigot could be elongate and the socket in the form of a corresponding elongate slot. Alternatively the spigot could be elongated and the socket be in the form of a pair of downwardly depending brackets formed on the underside of the plate 27 in which case the plate 27 would be spaced upwardly from the position shown in FIG. 2 so that the lower end of the brackets would lie in the same plane of the underside of the side walls of the parts 28.

Alternatively the spigot could be provided on the beam and socket on the head.

Further, the spigots provided on the heads 18 may be mounted so as to be rotatable around the axis of the bar 24 facilitating engagement between the spigots and sockets at high angles of slope.

Any other desired arrangement in which there are co-operating abutment surfaces on the beam and head to prevent relative movement between the beam and head in the longitudinal direction thereof, such as that described with reference to FIG. 3, hereinafter described may be used.

Also, any desired means may be provided to prevent movement between the beam and the head in a direction transverse to the longitudinal direction of the beam; again, an example of an alternative means is described with reference to FIG. 3.

Figure 3:
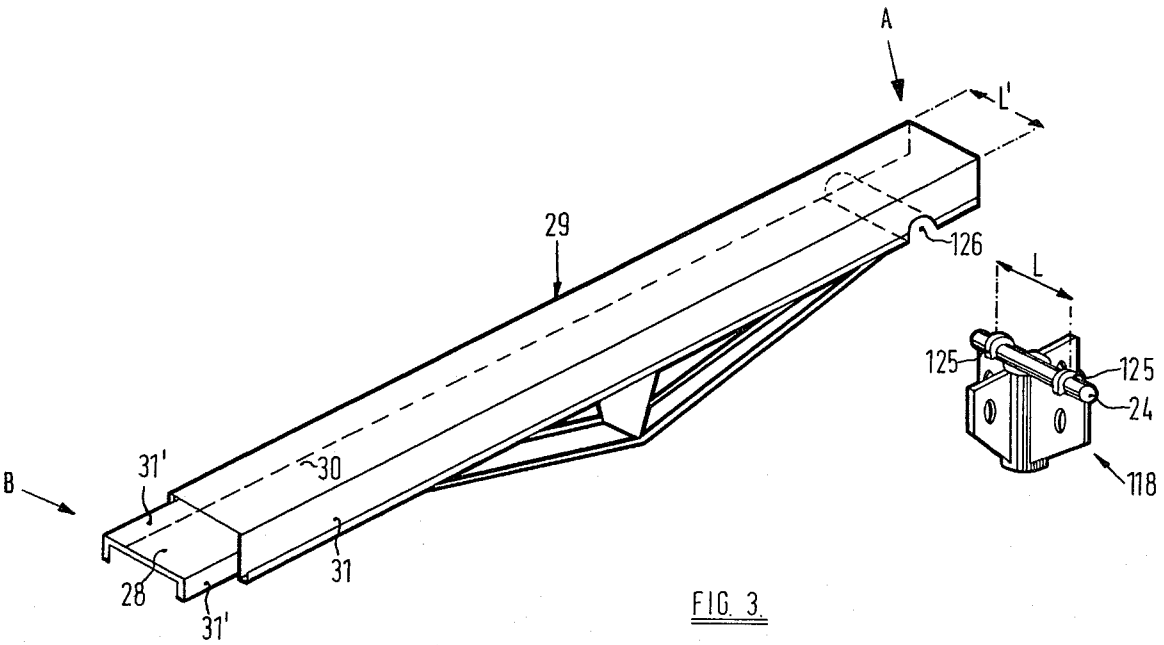
FIG. 3 is an exploded perspective view, to a similar enlarged scale, of part of a soffit supporting structure incorporating a second embodiment of the invention.

Referring now to FIG. 3 there is illustrated part of a support structure comprising a further embodiment of the invention.

A supporting head 118 is shown which is essentially the same as that described with reference to FIGS. 1 and 2, and therefore like parts will be designated by the same reference numeral.

Instead of spigots 25 which engage apertures in plates 27 on the underside of a reduced cross section part 28 of a beam, collars 125 are welded to the cylindrical bar 24 spaced apart by distant L which is slightly greater than the width L' of the beam 29 in the top hat section region. The purpose of these collars will become apparent hereinafter.

The beam 29 is provided with a semi-circular recess 126 of substantially similar radius as the cylindrical bar 24 of the head 118, the recesses 126 being provided in side flanges 31 adjacent, the end A of the beam 29.

In use, the recesses 126 receive and abut the cylindrical bar 24 of the support head 118 and thus relative movement between the beam 29 and the head 118 in the longitudinal direction of the beams is prevented.

Also in use, side flanges 31' of the reduced cross sectional part 28 of the beam 29 will rest on the cylindrical part 24 of an associated supporting head 118 and thus relative movement between the beam 29 and the head 118 will be allowed.

Two beams 29 of the second embodiment may be used to form a structure similar to that shown in FIG. 1 but in this embodiment, the higher end A of a sloping beam will be fixed longitudinally of the structure, and the lower end B will allow relative movement.

Two adjacent beams will telescope together in a similar manner to that described hereinbefore with reference to FIGS. 1 and 2, the reduced cross section part 28 of one beam 29 being received within the end A of an adjacent beam. The beams will be prevented from transverse movement relative to the longitudinal direction of the beam by the collars 125 on the bars 24 of the supporting heads 118. The collars 125 will abut the outsides of the side flanges 31 of the beams 29 in the regions of the recesses 126.

Thus it will be appreciated that the beams 29 are able to accommodate different spacings between supporting heads 118 on adjacent uprights 10 of a structure.

To introduce or remove an intermediate beam 29 in a structure comprising beams and supporting heads as shown in FIG. 3, substantially the same procedure is adopted as with the spigot and socket embodiment described with reference to FIGS. 1 and 2.

To introduce an immediate beam 29' in a structure, the depth of the recesses 126 in the flanges 31 are such that a reduced cross section part of a beam to be introduced can be inserted within the end A of a lower beam in a structure and engaged with a cylindrical part 24 of a supporting head 118, and the end A of the beam to be introduced may then be engaged over the reduced cross section part 28 of a higher beam in the structure, engaging the recesses 126 and the cylindrical bar 24 of the associated supporting heads 118.

To remove an intermediate beam 29' from a cast soffit whilst permitting other beams to remain in position, the upright 10 supporting the end A of the beam to be removed and an end B of an adjacent beam, is lowered to enable the end A of the beam to be removed to be lifted clear of the supporting head of the lowered upright and the beam slid axially to disengage the reduced cross sectional end of the beam to be removed from the larger cross sectional end of the next lowest beam to remain.

The primary shoring beams are generally adapted to carry transversely extending shoring beams having soffit engaging surfaces, to provide a complete shoring structure for the soffit.

I claim:

1. A soffit supporting structure comprising first and second parallel and vertically disposed props connected together by at least one horizontal member, the first prop being provided with a first supporting head at its upper end and the second prop with a second supporting head at its upper end, and a primary shoring beam supporting the soffit, the beam comprising first and second ends, the beam extending between the props, wherein first means are provided to fixedly support the first end of the beam by the first supporting head against movement in a direction parallel to the longitudinal axis of the beam and second means are provided to support the second end of the beam by the second supporting head for movement in a direction parallel to the longitudinal axis of the beam.

2. A soffit supporting structure according to claim 1 wherein a primary shoring beam is of fixed length.

3. A supporting structure according to claim 1 or claim 2 wherein the beam is of top hat section provided with an inturned lip at the free end of the out-turned flanges.

4. A supporting structure according to claim 1 wherein said first means comprise an abutment surface provided on the first end of the beam and a corresponding abutment surface on the first supporting head, said abutment surfaces engaging to prevent movement of the beam relative to the head in the longitudinal direction of the beam.

5. A supporting structure according to claim 4 wherein the abutment surfaces are provided by a spigot and socket assembly.

6. A supporting structure according to claim 5 wherein the beam slopes from a higher to a lower position and the first means are provided at the lower end of the sloping beam.

7. A supporting structure according to claim 6 wherein two sockets, in the form of apertures are provided on the beam at a position spaced transversely of the longitudinal axis of the beam and the head is provided with correspondingly located spigots extending generally radially from a cylindrical beam engaging surface of the head.

8. A supporting structure according to claim 4 wherein the abutment surfaces comprise a protrusion and a wall of corresponding recess.

9. A supporting structure according to claim 8 wherein the protrusion comprises a cylindrical beam-engaging surface of the first supporting head and the recess is a substantially similar configuration cut-out portion in the beam.

10. A supporting structure according to claim 8 or claim 9 wherein the beam slopes from a higher to a lower position and the first means are provided at the higher end of the sloping beam.

11. A supporting structure according to claim 10 wherein additional abutment surfaces comprising collars are provided on the cylindrical beam engaging surface of the head to prevent transverse movement of the beam relative to the supporting head, the collars, in use, abutting the beam in the region of the cut-out portion.

12. A supporting structure according to claim 5 wherein a second end of an adjacent primary shoring beam is supported by the first supporting head, one of said ends supported by the first supporting head being of reduced cross-section and telescoped within the other of said ends, the telescoped parts having dimensions to permit the end of reduced cross-section to be moved out of engagement with the first supporting head whilst the end of the adjacent beam also supported by the supporting head remains supported by the head, the or each spigot and the space between the telescoped ends of the adjacent beams having dimensions to permit the reduced cross-section end of the beam to be lifted out of engagement with the spigot and slid in an axial direction for removal of the beam from the structure.

13. A supporting structure according to claim 5 wherein in a second end of an adjacent primary shoring beam is supported by the first supporting head, one of said ends supported by the first supporting head being of reduced cross-section and telescoped within the other of said ends, the telescoped parts having dimensions to permit the end of reduced cross-section to be moved out of engagement with the second supporting head whilst the end of the adjacent beam also supported by the supporting head remains supported by the head, the height and depth of the protrusion and recess and the space between the telescoped ends of the adjacent beam being such to permit the reduced cross-section end of the beam to be lifted out of engagement with the supporting head and slid in an axial direction for removal of the beam from the structure.

* * * * *